US005309200A

United States Patent [19]

Michlin

[11] Patent Number: 5,309,200

[45] Date of Patent: May 3, 1994

[54] PHOTORECEPTOR DRUM, CHARGE ROLLER AND DEVELOPER BRUSH SPINNER DEVICE

[76] Inventor: Steven B. Michlin, 5310 Bentley Suite 105, West Bloomfield, Mich. 48322

[21] Appl. No.: 944,189

[22] Filed: Sep. 11, 1992

[51] Int. Cl.[5] ..... G03G 21/00; G03G 15/00

[52] U.S. Cl. ..... 355/200; 82/165; 82/166; 142/53

[58] Field of Search ..... 355/200, 211, 212, 213; 82/148, 152, 165, 166; 142/53

[56] References Cited

U.S. PATENT DOCUMENTS

| | | | |
|---|---|---|---|
| 2,876,807 | 3/1959 | Christensen | 142/53 X |
| 3,608,915 | 9/1971 | Hohwart | 82/165 X |
| 3,862,391 | 1/1975 | Blomgren et al. | 219/68 |
| 4,839,690 | 6/1989 | Onoda et al. | 355/211 |
| 4,975,744 | 12/1990 | Ebata et al. | 355/211 |
| 5,079,401 | 1/1992 | Suchan | 219/121.68 |
| 5,132,728 | 7/1992 | Suzaki et al. | 355/211 X |

*Primary Examiner*—Fred L. Braun

[57] ABSTRACT

Components are disclosed which allow a powerful, variable speed lathe to turn the photoreceptor drums, charge rollers and developer brushes of printers, copiers, and facsimile machines. In one embodiment, adapter units fit over the cylindrical extensions on the ends of the drum. Two pieces of opposing tail stock support and hold the drum on the lathe by applying pressure against the adapter units. A drive bushing is attached to and rotates with the drive bolt of the lathe. The drive bushing has one or more drive pins which interact with the spoke-like members on the drum to turn or spin the drum and allow it to be cleaned, polished, coated or otherwise treated. In a second embodiment, a short length of hose is used to connect the adapter unit with the charge roller or developer brush. The drive pin of the drive bushing is received in a hole on the surface of the adapter unit facing the drive bushing. The roller or brush is turned on the lathe by having the drive bushing turn the adapter unit. The same drive bushing, adapter units and tail stocks can therefore be used to drive photoreceptor drums, charge rollers and developer brushes. Depending on the type of photoreceptor drum end, it is possible to spin the drum using just the drive bushing and tail stock without an adapter unit.

18 Claims, 8 Drawing Sheets

PHOTORECEPTOR DRUM, CHARGE ROLLER AND DEVELOPER BRUSH SPINNER DEVICE

BACKGROUND OF THE INVENTION

In printers, copiers and facsimile machines, dry toner is transferred to paper to produce an image. In simple terms, a charge roller rubs against a photoreceptor drum, and charges it. When light (the photo image) shines on the drum, the drum gets an image. The light removes the charge from the drum where it shines on the drum, in little pixel increments, so there is no charge where the image is, and the drum remains charged where there is no image. A developer brush is located close to the drum and is surrounded by dry toner. It applies toner to the drum where the drum is not charged. So where the image is, the drum is black, and the drum is white (no image) where the drum is charged. A second charge roller is on the opposite side of the paper from the drum. The drum rotates forward and the second charge roller attracts toner from the drum onto the paper. The image is transferred from the drum to the paper. Toner is then melted on the paper by fuser rollers.

The photoreceptor drum is exposed to ozone and the outer portion of the charge transport layer's (the outermost layer) structure changes from its original state to a different state, reducing its performance level and the quality of its image. Toner, paper particles and other debris also get on the drum, roller and developer brush. When charge rollers get dirty, for example, they can malfunction, causing streaks and/or grey haze on the output paper.

As a result of this, the drums, rollers and developer brushes need to be cleaned, polished, waxed and otherwise treated. For example, once the outer portion, of the charge transport layer, the modified portion is removed from the drum surface, the surface may need to be treated with a hard protective coating. The drums, rollers and brushes are usually cleaned with a cotton pad soaked in alcohol. In the copier, laser printer, facsimile machine industry, and in the cartridge remanufacturing industry, the lathes available specifically to rotate drums for ease of treatment have small inadequate motors designed for one speed. If any real pressure is applied on the drums, rollers and brushes, the lathe will stop. It is believed that no means currently exists in the industry for turning charge rollers and developer brushes on any type of lathe. More powerful motors with variable speed are needed to turn these devices so they may be properly cleaned and treated.

SUMMARY OF THE INVENTION

This disclosure is directed towards a set of components used to modify a conventional, variable speed, powerful wood lathe so it may be used to rotate photoreceptor drums, charge rollers or brushes used in dry toner printers, copiers, and facsimile machines. Adapter units attach to the drum, roller, or brush and allow tail stock members to hold these devices on the lathe. A drive bushing screws on the drive bolt of the lathe and interacts with either the drum or an adapter unit to turn the drum, roller or brush.

By use of these components, conventional powerful, variable speed lathes readily available on the market may be used to rotate photoreceptor drums for the purposes of cleaning, waxing, polishing, drum coating or other treatment. Similar treatments may be performed on charge rollers and developer brushes to increase the performance and life of these devices.

DESCRIPTION OF THE PREFERRED EMBODIMENT

Figure 1:
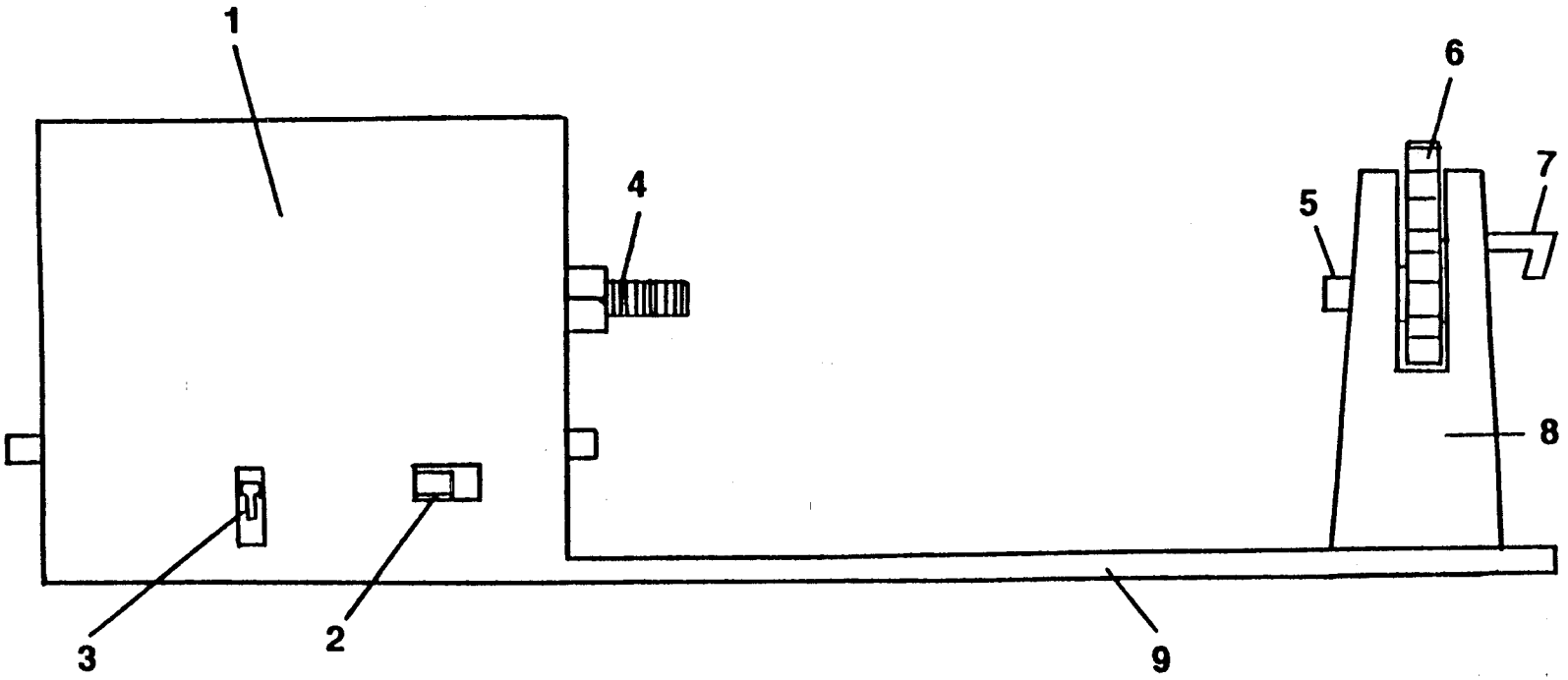
Prior Art Figure 1
FIG. 1 shows a conventional, variable speed wood lathe.

FIG. 1 shows a conventional, variable speed wood lathe which will be modified by this invention to rotate (spin) photoreceptor drums, charge rollers and developer brushes. The motor is indicated at reference numeral 1. There is an on/off switch 2. A lever 3 moves the motor up and down, changing the belt tension so the belt can be moved to a different pulley and the speed of the lathe changed. The motor turns a drive bolt 4 which is nut-shaped at one end with an outside-threaded hollow rod extending from the nut-shaped portion. A hollow holding member 5 is located at the other end of the lathe and may be moved towards or away from the drive bolt 4 by a wheel 6. A lever 7 fixes the holding member 5 in the chosen position. The whole attachment 8 can also be positioned relative to the drive bolt 4 by sliding the attachment along the platform 9 and fixing it in the desired location. In conventional operation, the device to be spinned (for example a block of wood) would be attached between the drive bolt 4 and the holding member 5. Usually a member with a cross-shaped end would be attached to the drive bolt, and something placed in the holding member 5 would force the device against the cross-shaped end. As the motor turns the drive bolt along its longitudinal axis, the device would rotate or spin with the drive bolt.

Figure 2:
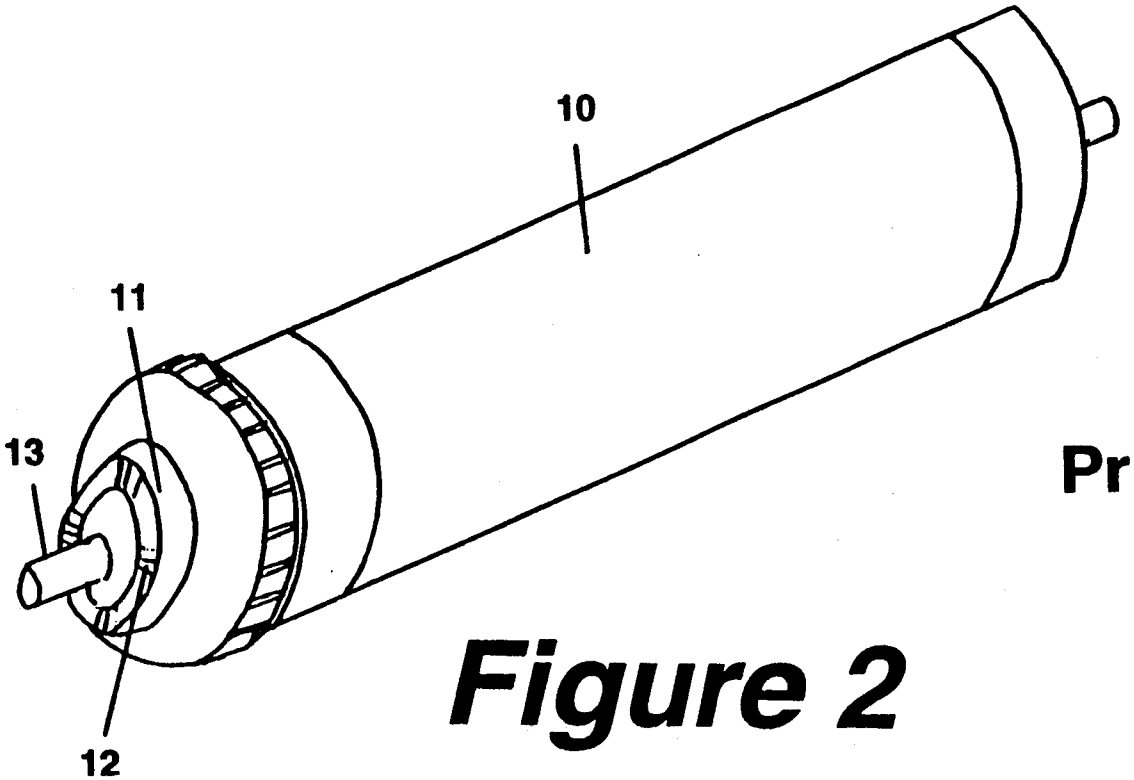
Prior Art Figure 2
FIG. 2 shows a conventional photoreceptor drum.

FIG. 2 shows a conventional photoreceptor drum 10. It has a circular end piece 11 with interior spoke-like members 12. A cylindrical metal extension 13 extends from the end piece and the drum.

Figure 3:
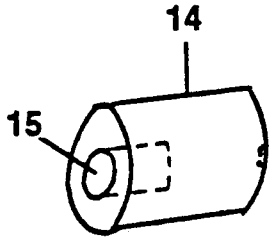
FIG. 3 shows an adapter unit of this invention.
Figure 4:
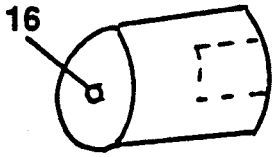
FIG. 4 shows an adapter unit of this invention (showing a face opposite the one shown in FIG. 3).

FIGS. 3 and 4 show the adapter unit of this invention. As shown in FIG. 3, the adapter unit 14 is a small cylindrical member with a bore 15 extending into it. The bore 15 has a diameter just large enough to receive the cylindrical extension 13 of the photoreceptor drum 10. The other end or face of the adapter unit has a small drilled hole or dimple 16 at its center, as shown in FIG. 4. The adapter unit is made of hardened steel.

Figure 5:
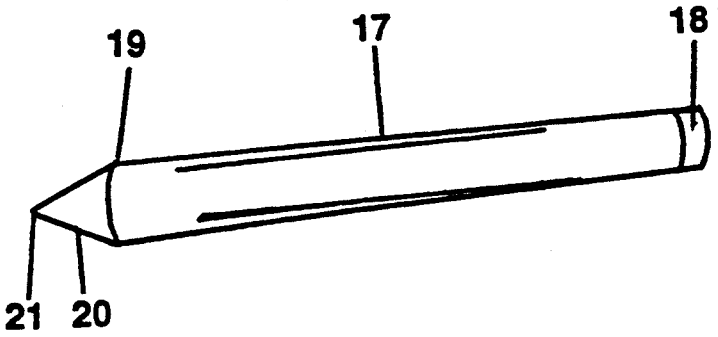
FIG. 5 shows the tailstock component of this invention.

FIG. 5 shows a hardened steel tail stock component 17. Two of these components 17 are used to hold or support the drum, roller or brush on the lathe. The tail stock is in the shape of a tapered cylinder with a narrow end piece 18 and a wide end 19. At the wide end 19 there is a short conical portion 20 converging to a point 21. In use, one tail stock would fit into the drive bolt 4 and one tail stock would fit into the holding member 5, such that the points 21 would face each other across the platform 9 of the lathe.

Figure 6:
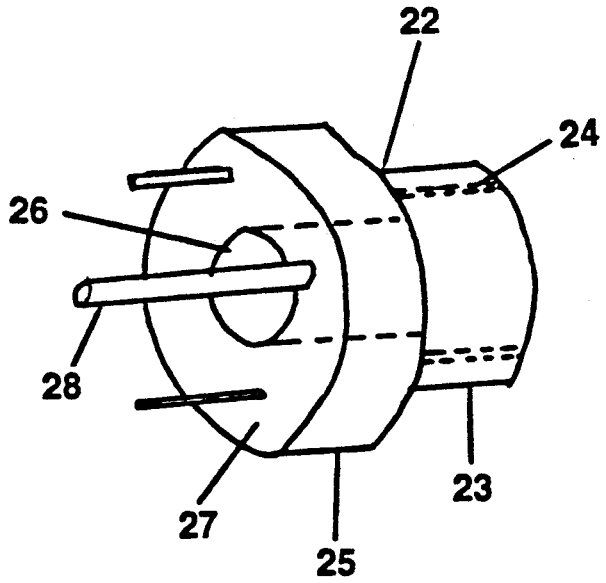
FIG. 6 shows the drive bushing of this invention.

FIG. 6 shows the steel drive bushing component of this invention. The drive bushing 22 has a hollow first cylindrical portion 23 with inside threads 24. It is designed to screw onto the drive bolt 4 of the lathe. The drive bushing has a second cylindrical portion 25 with a bore 26 through it. The bore 26 connects with the inside of the first cylindrical portion 23 to form a passage extending completely through the drive bushing. The bore 26 has a diameter larger than the largest diameter of the tail stock component 17. There are holes drilled in the face 27 of the second cylindrical portion 25 for receiving one or more drive pins 28. The drive pins are of different diameter, length and radial location on the face. They are also removable from the drive bushing.

Figure 7:
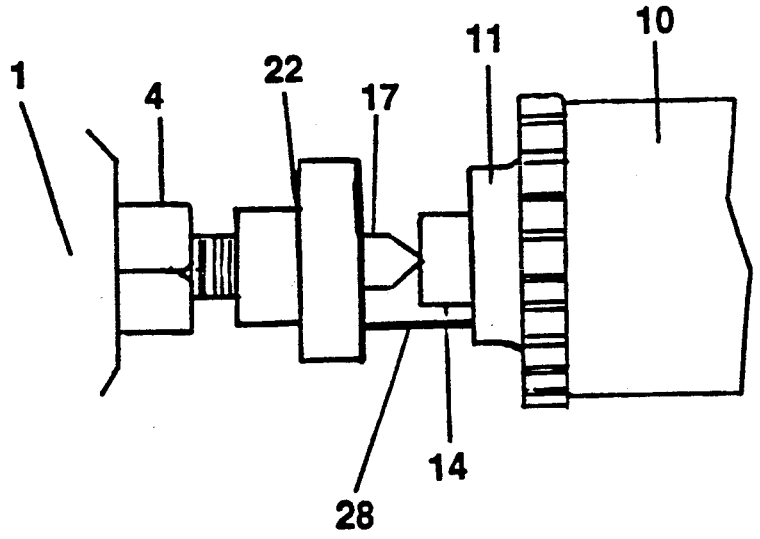
FIG. 7 is a partial illustration of the components of the invention in use.

FIG. 7 is a partial illustration of how the three components interact to spin or rotate the photoreceptor drum. The bore 15 of the adapter unit 14 is approximately as deep as the cylindrical extension 13 of the drum is long. The adapter unit fits over the extension. The drive bushing 22 is screwed onto the drive bolt 4 of the lathe. The tail stock is placed in the drive bushing and drive bolt. The dimple 16 of the adapter unit receives the point 21 and part of the conical portion 20 of the tail stock. An adapter unit and tail stock are also used at the holding member 5 side of the lathe. The wheel 6 is adjusted so the drum is held between opposite compressive forces acting through the tail stocks and adapter units. The drive pin 28 interacts with the spoke-like members 12 in the circular end piece 11 of the drum to turn the drum as the drive bushing rotates with the drive bolt of the lathe. Note that the tail stocks and adapter units only support and fix the drum in position. They do not rotate the drum because they are not turned by the drive bolt. Different drive pins 28 would be used depending on the type of drum to be turned. Using these components, a variable speed lathe may be used to rotate the drum and allow for more efficient treatment of the drum.

Figure 8:
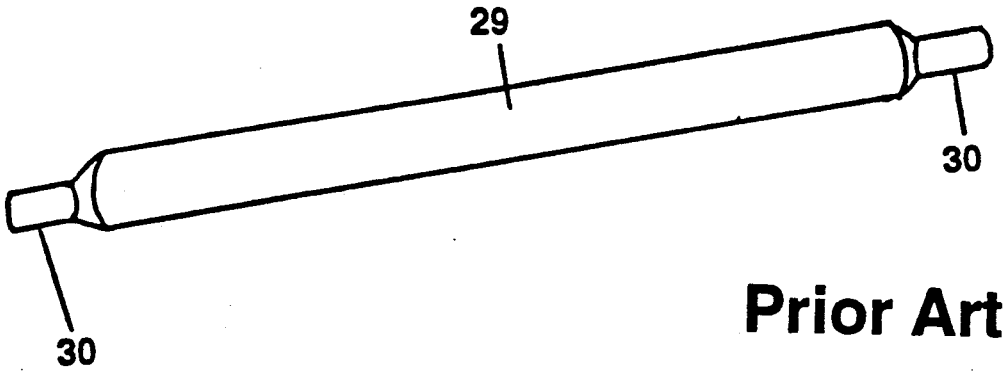
FIG. 8 shows a conventional charge roller.
Figure 9:
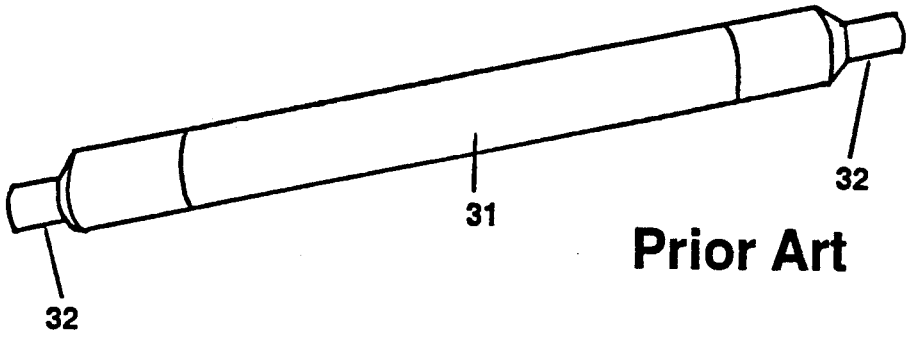
FIG. 9 shows a conventional developer brush.

A further embodiment of this invention allows the spinner components described above to turn charge rollers and developer brushes. FIG. 8 shows a conventional charge roller 29. It has short metal cylindrical extensions 30. FIG. 9 shows a conventional developer brush 31. It is larger in diameter than the charge roller 29, and the metal cylindrical extensions 32 of the developer brush are also larger in diameter than the extensions 30 of the charge roller, but smaller in diameter than the cylindrical extensions 13 of the photoreceptor drum.

Figure 10:
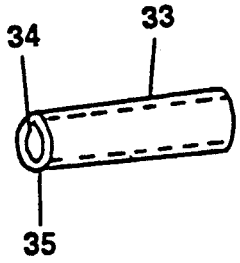
FIG. 10 shows a piece of hose used in this invention.

The objective here is to have the spinning components that rotate the drum also rotate the roller and brush. One option would be to provide adapter units with smaller bores 15 to receive the smaller cylindrical extensions 30 and 32 of the roller and brush, respectively. Another option would be to use the short, flexible piece of hose shown in FIG. 10. The hose 33 has an inside diameter 34 sized to fit around, for example, the cylindrical extension 30 of the charge roller 29. The outside diameter 35 would fit snugly into the bore 15 of the adapter unit 14. A different-sized hose piece could be provided for each extension 32 of the developer brush 31 also.

Figure 11:
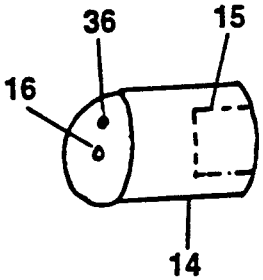
FIG. 11 shows a slightly modified adapter unit.
Figure 12:
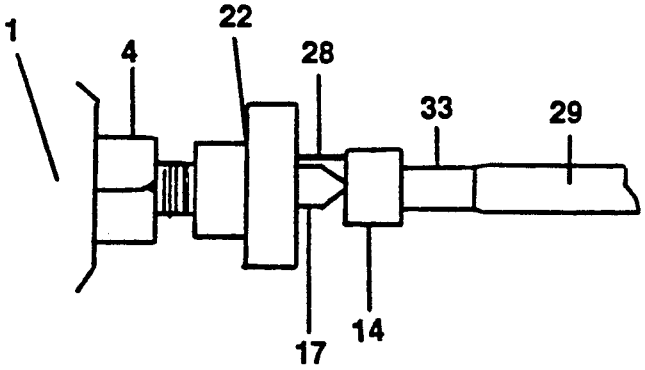
FIG. 12 is a partial illustration of the invention with the components slightly modified.

Since the charge roller and developer brush do not have a circular end piece with spoke-like members like the photoreceptor drum, a hole for receiving a drive pin of the drive bushing is drilled in the surface of the adapter unit 14 containing the dimple 16. This hole 36 is shown in FIG. 11. The whole concept is illustrated in FIG. 12. The reason for the removable, different-sized, different-positioned drive pins 28 should now be clear. The drive bushing 22 rotates the adapter 14. The snugness of the fit between the adapter 14 and the hose 33 and between the hose 33 and the cylindrical extension 30 of charge roller 29, and the tail stocks 17 providing opposing forces from each end of the lathe, causes the charge roller 29 to turn with the adapter. Using the spinning components in this manner allows a variable speed lathe to rotate the brush and roller so these devices may be more efficiently cleaned, polished, or otherwise treated.

Figure 14:
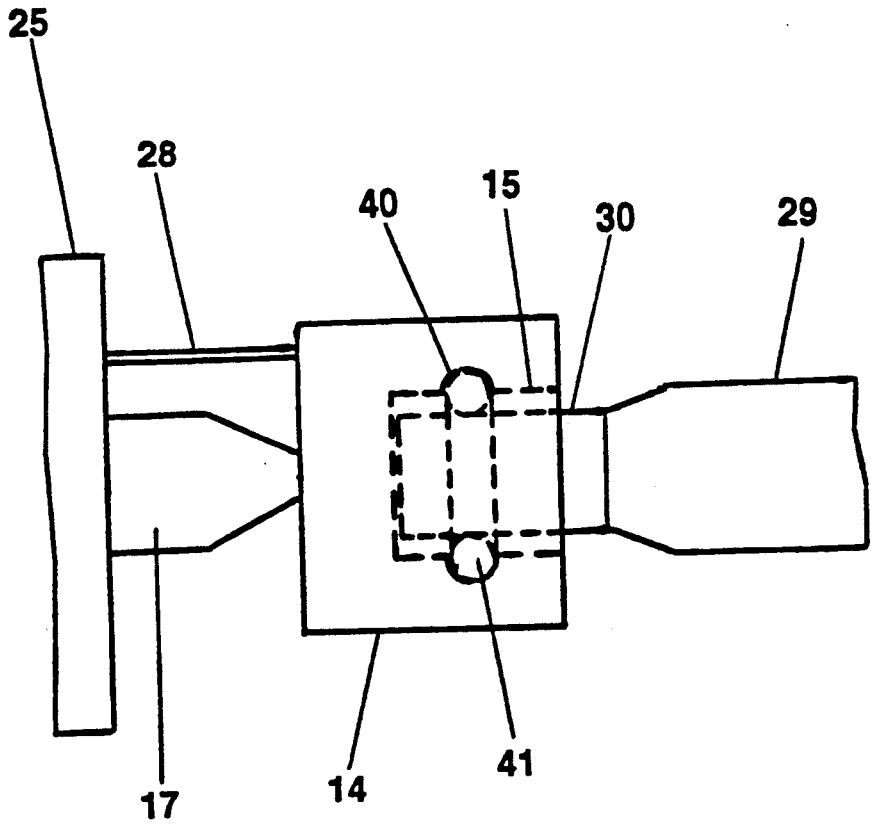
FIG. 14 is an enlarged partial illustration of the invention shown in FIG. 12 but using an o-ring instead of a hose for snugly receiving the part to be rotated.

Various modifications on the hose component of FIG. 12 re possible. As shown in FIG. 14, rather than using the hose 33, a groove 40 could be machined in the adapter bore 15 for receiving a flexible o-ring 41. The o-ring 41 would be of a diameter sized to snugly fit over the cylindrical extensions 30 and 32 of the roller and brush, performing the function of the hose 33. Or a rubber dip such as the type used to make handles for hand tools could be used to provide a layer of flexible coating in the adapter bore 15. The layer would be of a thickness such that the cylindrical extensions 30 and 32 of the roller and brush are snugly received in the bore of the adapter. The friction between the coating and the extension would cause the roller or brush to turn when the adapter is turned by the drive bushing.

Figure 13:
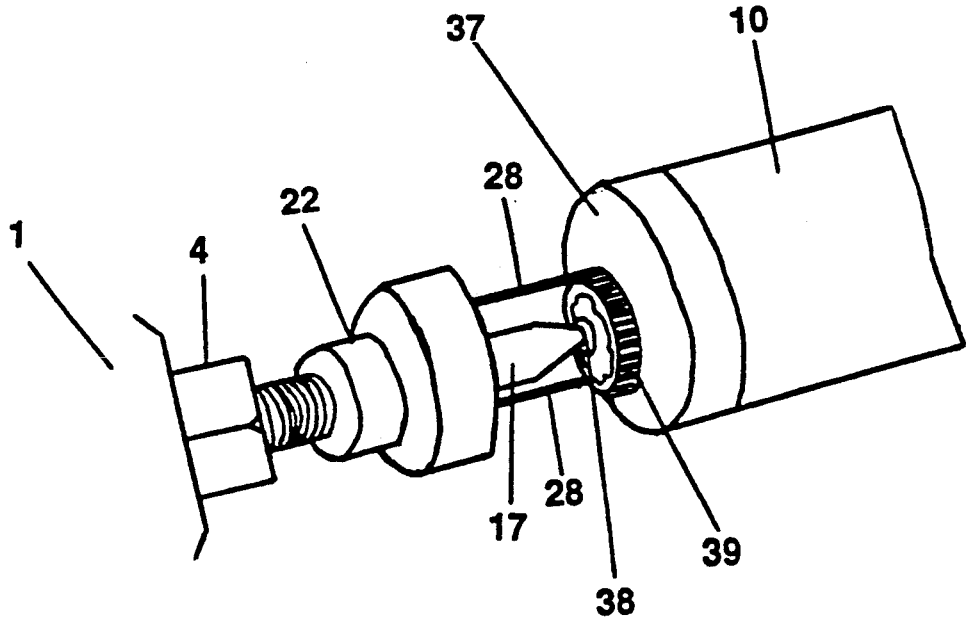
FIG. 13 shows how the invention would be used without the adapter unit when a different-ended drum is to be turned.

FIG. 13 shows a photoreceptor drum end 37 of the type having an orifice 38 surrounded by a gear 39. The gear is part of the drum end and will not rotate relative to the drum. In this case, an adapter unit is not needed to turn the drum. Part of the conical end portion 20 of the tail stock 17 would fit into the orifice 38 and support the drum on the lathe. The drive pins 28 of the drive bushing 22 would mesh with the gear 39 to rotate the gear and drum when the lathe is in operation. The drive pins 28 are less likely to break when more than one are used.

This description is not meant to limit the scope of the invention. The invention as described and as claimed in the following claims is intended to encompass reasonable equivalents and obvious modifications.

What is claimed is:

1. A spinning means for modifying a variable speed lathe so it may be used to turn the photoreceptor drums, charge rollers and developer brushes used in dry toner copying, printing and facsimile machines, said spinning means comprising an adapting means for fitting on the ends of said drum, roller or brush, a holding means for acting against said adapting means to support said drum, roller or brush on the lathe, and a drive means for turning said drum, roller or brush when the lathe is in operation, said holding means comprising two pieces of tail stock, each piece having a first end for attaching to said lathe at opposite sides of said lathe and a second end for applying pressure through said adapting means against said drum, roller or brush to hold said drum, roller or brush in position on said lathe between said two pieces of tail stock, said adapting means including a receiving means for receiving said second end of said tail stock and a cylindrical bore in a surface opposite said receiving means, and said drum, roller or brush includes a cylindrical end extension with a diameter much smaller than said bore, said adapting means further including a short length of hose with an outside diameter slightly smaller than said bore and an inside diameter slightly larger than said end extension of said drum, roller or brush, whereby said hose is snugly received in said bore and said end extension of said drum, roller or brush may be snugly received in said hose, attaching said adapting means to said drum, roller or brush.

2. A spinning means as in claim 1 wherein said first end of said tail stock is the narrow end of a tapered cylinder.

3. A spinning means as in claim 2 wherein said second end of said tail stock is a short conical portion extending from the wide end of said tapered cylinder and converging to a point.

4. A spinning means as in claim 3 wherein said receiving means of said adapting means is a dimple for receiving said point and part of said short conical portion of said tail stock.

5. A spinning means as in claim 1 wherein said lathe has a drive bolt with outside threads, and said drive means has first and second cylindrical portions, said first cylindrical portion having a bore in it with inside threads such that said drive means may be screwed on to said drive bolt of said lathe.

6. A spinning means as in claim 5 wherein said second cylindrical portion of said drive means has a smooth bore extending through it and connecting with the inside threaded bore of said first cylindrical portion such that a passage is formed completely through said drive means through which said first end of said tail stock may extend.

7. A spinning means as in claim 6 wherein said second cylindrical portion of said drive means has a surface facing away from said first cylindrical portion, said surface having a drive pin extending from it, said receiving means of said adapting means being in a surface of said adapting means facing said surface of said second cylindrical portion of said drive means, said surface of said adapting means containing said receiving means also including a hole for receiving said drive pin, whereby said drive means may turn said adapting means causing the roller or brush to turn also when said lathe is in operation.

8. A spinning means as in claim 1 wherein said drive means includes a drive pin for contacting said drum and spinning it when said lathe is in operation.

9. A spinning means as in claim 1 wherein said drive means includes a drive pin, and said adapting means includes a hole for receiving said drive pin, whereby said drive means may rotate said adapting means to spin said roller or brush when the lathe is in operation.

10. A spinning means as in claim 1 wherein said adapting means is a short cylinder.

11. A spinning means for modifying a variable speed lathe so it may be used to turn the photoreceptor drums, charge rollers and developer brushes used in dry toner copying, printing and facsimile machines, said spinning means comprising an adapting means for fitting on the ends of said drum, roller or brush, a holding means for acting against said adapting means to support said drum, roller or brush on the lathe, and a drive means for turning said drum, roller or brush when the lathe is in operation, said holding means comprising two pieces of tail stock, each piece having a first end for attaching to said lathe at opposite sides of said lathe and a second end for applying pressure through said adapting means against said drum, roller or brush to hold said drum, roller or brush in position on said lathe between said two pieces of tail stock, said adapting means including a receiving means for receiving said second end of said tail stock and a cylindrical bore in a surface opposite said receiving means, and said drum, roller or brush includes a cylindrical end extension with a diameter slightly smaller than said bore, whereby said end extension of said rum may be received in said bore of said adapting means, attaching said adapting means to said drum, and said lathe includes a drive bolt with outside threads, said drive means has first and second cylindrical portions, said first cylindrical portion having a bore in it with inside threads such that said drive means may be screwed on to said drive bolt of said lathe, said second cylindrical portion of said drive means has a smooth bore extending through it and connecting with the inside threaded bore of said first cylindrical portion such that a passage is formed completely through said drive means through which said first end of said tail stock may extend.

12. A spinning means as in claim 11 wherein said second cylindrical portion of said drive means has a surface facing away from said first cylindrical portion, said surface having a drive pin extending from it, said photoreceptor drum having a circular end piece with spoke-like members around said end extension, whereby said drive pin may interact with said spoke-like members to turn or spin said drum when said lathe is in operation.

13. A spinning means as in claim 12 wherein said surface of said second cylindrical portion of said drive means has additional drive pins extending rom it, said drive pins being of different length, diameter and radial position such that the same drive means may be used to turn different drums, rollers or brushes.

14. A spinning means as in claim 13 wherein said drive pins are removable from said drive means.

15. A spinning means as in claim 11 wherein said first end of said tail stock is the narrow end of a tapered cylinder.

16. A spinning means as in claim 15 wherein said second end of said tail stock is a short conical portion extending from the wide end of said tapered cylinder and converging to a point.

17. A spinning means as in claim 16 wherein said receiving means of said adapting means is a dimple for receiving said point and part of said short conical portion of said tail stock.

18. A spinning means for modifying a variable speed lathe so it may be used to turn the photoreceptor drums, charge rollers and developer brushes used in dry toner copying, printing and facsimile machines, said spinning means comprising an adapting means for fitting on the ends of said drum, roller or brush, a holding means for acting against said adapting means to support said rum, roller or brush on the lathe, and a drive means for turning said drum roller or brush when the lathe is in operation, said holding means comprising two pieces of tail stock, each piece having a first end for attaching to said lathe and a second end for applying pressure through said adapting means against said drum, roller or brush to hold said drum; roller or brush in position on said lathe between said two pieces of tail stock, said adapting means including a receiving means for receiving said second end of said tail stock and a cylindrical bore in a surface opposite said receiving means, and said drum, roller or brush includes a cylindrical end extension with a diameter smaller than said bore, said adapting means further including a groove located in said cylindrical bore and a flexible o-ring received in said groove, said o-ring being sized to snugly fit over said cylindrical end extension of said drum, roller or brush when said cylindrical end extension is placed in said cylindrical bore of said adapting means, attaching said adapting means to said drum, roller or brush.

* * * * *